US010587955B2

(12) United States Patent
Ohara

(10) Patent No.: US 10,587,955 B2
(45) Date of Patent: Mar. 10, 2020

(54) SPEAKER VIBRATING MEMBER AND METHOD OF MAKING THE SAME

(71) Applicant: Hiroshi Ohara, Taoyuan County (TW)

(72) Inventor: Hiroshi Ohara, Taoyuan County (TW)

( * ) Notice: Subject to any disclaimer, the term of this patent is extended or adjusted under 35 U.S.C. 154(b) by 315 days.

(21) Appl. No.: 15/440,135

(22) Filed: Feb. 23, 2017

(65) Prior Publication Data

US 2017/0251307 A1 Aug. 31, 2017

(30) Foreign Application Priority Data

Feb. 26, 2016 (TW) ..... 105105961 A

(51) Int. Cl.

| | |
|---|---|
| ***H04R 7/12*** | (2006.01) |
| ***H04R 9/04*** | (2006.01) |
| ***H04R 9/06*** | (2006.01) |
| ***H04R 31/00*** | (2006.01) |

(52) U.S. Cl.

CPC ..... *H04R 7/125* (2013.01); *H04R 9/043* (2013.01); *H04R 9/06* (2013.01); *H04R 31/003* (2013.01); *H04R 2307/021* (2013.01); *H04R 2307/025* (2013.01); *H04R 2307/029* (2013.01)

(58) Field of Classification Search

CPC ..... H04R 7/125; H04R 9/06; H04R 2307/025
See application file for complete search history.

(56) References Cited

U.S. PATENT DOCUMENTS

| | | | | |
|---|---|---|---|---|
| 6,039,145 | A * | 3/2000 | Ogura | H04R 7/125 181/167 |
| 2003/0233012 | A1* | 12/2003 | Jackson | B01J 21/08 560/208 |
| 2004/0168851 | A1* | 9/2004 | Imamura | H04R 7/125 181/169 |
| 2005/0232458 | A1* | 10/2005 | Hachiya | H04R 7/12 381/426 |
| 2007/0148353 | A1* | 6/2007 | Mizone | C09D 11/10 427/256 |
| 2009/0226685 | A1* | 9/2009 | Yoshioka | B28B 1/008 428/210 |
| 2010/0040943 | A1* | 2/2010 | Kim | H01M 2/0426 429/163 |

* cited by examiner

*Primary Examiner* — Robert A Vetere
(74) *Attorney, Agent, or Firm* — Lin & Associates Intellectual Property, Inc.

(57) ABSTRACT

The present invention provides a method for making a speaker vibrating member, including: impregnating a fiber cloth with a resin solution for at least one time; removing the fiber cloth from the resin solution, and impregnating the fiber cloth with a water-based rubber solution for at least one time; drying the fiber cloth; forming at least one speaker vibrating member shaped portion on a dried fiber cloth; and cutting the at least one speaker vibrating member shaped portion off from the dried fiber cloth to acquire the speaker vibrating member. In such a way, the fiber cloth may be prevented from sticking with the mold during the formation step due to the protection provided by the release layer. In addition, the speaker vibrating member manufactured by the method has a higher flexibility and a remarkable fatigue resistance; consequently, the sound quality of the speaker may be enhanced.

6 Claims, 5 Drawing Sheets

SPEAKER VIBRATING MEMBER AND METHOD OF MAKING THE SAME

CROSS-REFERENCE TO RELATED APPLICATION

This application claims the priority of Taiwanese patent application No. 105105961, filed on Feb. 26, 2016, which is incorporated herewith by reference.

BACKGROUND OF THE INVENTION

1. Field of the Invention

The present invention relates to a speaker vibrating member and a method of making the same.

2. The Prior Arts

FIG. 1 illustrates a structure of a moving-coil speaker 1. When the moving-coil speaker 1 is in operation, electricity is configured to flow through a voice coil 14 to generate an electromagnetic field. The electromagnetic field generated is orthogonal to a magnetic field of a permanent magnet 15 of the moving-coil speaker 1, so the voice coil 14 is applied with a force and is moved correspondingly. In such a way, a drum paper 11 may vibrate in a vertical direction and an up-down direction to cause air vibrations and thereby emitting audio frequency. Therefore, a vibrating member is usually referring to the drum paper 11, a damper 12 and a connecting member 13. FIG. 2 illustrates the primary structure of the damper 12. The damper 12 is mainly used to suspend the voice coil 14 and the drum paper 11, and usually has a structure composed of a multiple concentric circles with a wavy cross section. Because the voice coil 14 and the drum paper 11 are supported by the damper 12, the quality of the damper 12 has direct influence on the vibration amplitude of the drum paper 11; as a result, the quality of the damper 12 also affects the sound quality of the moving-coil speaker 1. Among the structural members of the moving-coil speaker 1, all members that are capable of causing vibrations may be referred to as vibrating members, such as the damper 12, the drum paper 11 and the connecting member 13.

One of a conventional way to manufacture a speaker vibrating member is to form a complete piece of speaker vibrating member by undertaking a roll of fiber cloth through an impregnating step, a drying step, a formation step, a cutting step and etc. The impregnating step involves impregnating the fiber cloth with a resin solution. Through such processes, a stiffness of the fiber cloth may be increased after the fiber cloth is dried. However, such speaker vibrating members have the downside of being overly stiff, having low fatigue resistance (i.e. having poor elastic restoring force) and lacking flexibility. Hence, such speaker vibrating members are easily fatigued and thus may easily rupture, thereby compromising the overall sound effect of the speaker.

Furthermore, in the formation step of the conventional method for manufacturing the speaker vibrating member, a speaker vibrating member shaped portion is typically hot embossed on the fiber cloth with a mold. Hence, during the demolding process, the speaker vibrating member shaped portion may easily be stuck with the mold.

Based on the above reasons, there is a need for the industry to develop a speaker vibrating member with a better flexibility and an outstanding fatigue resistance; in addition, a method for making such speaker vibrating member that is free of the mold-sticking problem is also in need.

SUMMARY OF THE INVENTION

A primary objective of the present invention is to provide a method for making a speaker vibrating member such that a rubber layer is formed on a resin layer of the fiber cloth. In such a way, the speaker vibrating member produced may have a better flexibility and an exceptional fatigue resistance (i.e. high elastic restoring force), and the sound quality of the speaker may be improved.

A secondary objective of the present invention is to provide a method for making a speaker vibrating member such that multiple rubber layers are formed on a resin layer of the fiber cloth. Hence, the number of the rubber layers may be adjusted accordingly for a desired stiffness of the fiber cloth, so the speaker vibrating member produced may have an even better flexibility and a more outstanding fatigue resistance. As a result, the speaker manufactured with such speaker vibrating member may provide enhanced sound quality.

Another objective of the present invention is to provide a method for making a speaker vibrating member such that a release layer is formed on the outermost rubber layer of the fiber cloth. In such a way, the mold-sticking problem may be prevented in the formation step.

A further objective of the present invention is to provide a speaker vibrating member manufactured with rubber. Such speaker vibrating member is configured to have an exceptional fatigue resistance so as to improve the sound quality of the speaker.

In order to achieve the foregoing objectives, the present invention provides a method for making a speaker vibrating member, including the steps of:

first impregnating step: impregnating a fiber cloth with a resin solution for at least one time.

second impregnating step: removing the fiber cloth from the resin solution, and impregnating the fiber cloth with a water-based rubber solution for at least one time.

drying step: drying the fiber cloth.

formation step: forming at least one speaker vibrating member shaped portion on the dried fiber cloth.

cutting step: cutting the at least one speaker vibrating member shaped portion off from the dried fiber cloth to acquire the speaker vibrating member.

Preferably, the fiber cloth is impregnated with the resin solution for one time in the first impregnating step, and the fiber cloth is removed from the resin solution to be impregnated in the water-based rubber solution for multiple times in the second impregnating step. Furthermore, in the second impregnating step, the fiber cloth is dried directly after being removed from the resin solution, and the dried fiber cloth is impregnated with the water-based rubber solution; subsequently, the fiber cloth is dried directly after being removed from the water-based rubber solution, and the dried fiber cloth is impregnated with the water-based rubber solution again. The above steps are repeatedly performed until the fiber cloth is impregnated with the water-based rubber solution for multiple times.

Preferably, after the fiber cloth is impregnated with the water-based rubber solution for a last time in the second impregnating step, the fiber cloth is removed from the water-based rubber solution and is impregnated with a release agent. Furthermore, the fiber cloth is dried directly after being removed from the water-based rubber solution, and the dried fiber cloth is impregnated with the release agent that has a concentration of 5%-10%.

Preferably, a type of rubber used in the water-based rubber solution is styrene-butadiene rubber (SBR), and the SBR has a concentration of 1%-80%.

Further, in order to achieve the foregoing objects, the present invention provides a speaker vibrating member including a main body, a resin layer and at least one rubber layer.

The resin layer is disposed on a surface of the main body.

The rubber layer is disposed on a surface of the resin layer.

Preferably, the speaker vibrating member includes multiple rubber layers. One of the rubber layers is disposed on the surface of the resin layer, and the rest of the rubber layers are laminated on one another layer by layer.

Preferably, the speaker vibrating member further includes a release layer, which is disposed on a surface of an outermost rubber layer.

Preferably, the rubber layer is a styrene-butadiene rubber (SBR) layer.

The present invention is advantageous in that the speaker vibrating member manufactured by the method provided has a higher flexibility and a remarkable fatigue resistance; consequently, the sound quality of the speaker may be enhanced. In particular, after the speaker vibrating member is impregnated with the rubber solution for multiple times, multiple rubber layers may be formed on the resin layer. The effect of the rubber layer is most prominent when SBR is used as the solvent in the rubber solution. As a result, users may adjust the stiffness of the fiber cloth as desire, so the speaker vibrating member is manufactured with a higher flexibility and a more outstanding fatigue resistance for providing a better sound quality. In addition, when the fiber cloth is being impregnated for the last time, it is impregnated with a release agent to form a release layer on the outermost rubber layer. In such a way, the fiber cloth may be prevented from sticking with the mold during the formation step.

BRIEF DESCRIPTION OF THE DRAWINGS

Other purposes, advantages and innovative features of the present invention will be apparent to those skilled in the art by reading the following examples with reference to the appended drawings.

DETAILED DESCRIPTION OF THE PREFERRED EMBODIMENT

The accompanying drawings are included to provide a further understanding of the invention, and are incorporated in and constitute a part of this specification.

Figure 1:
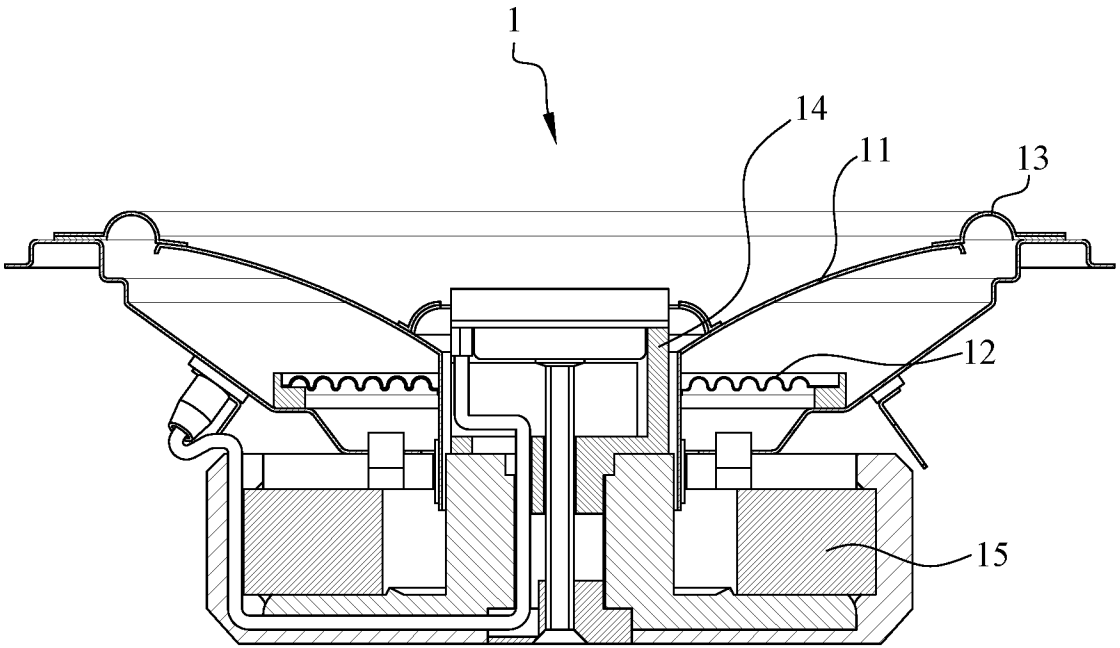
FIG. 1 (PRIOR ART)
FIG. 1 is a sectional view illustrating a conventional speaker.
Figure 2:
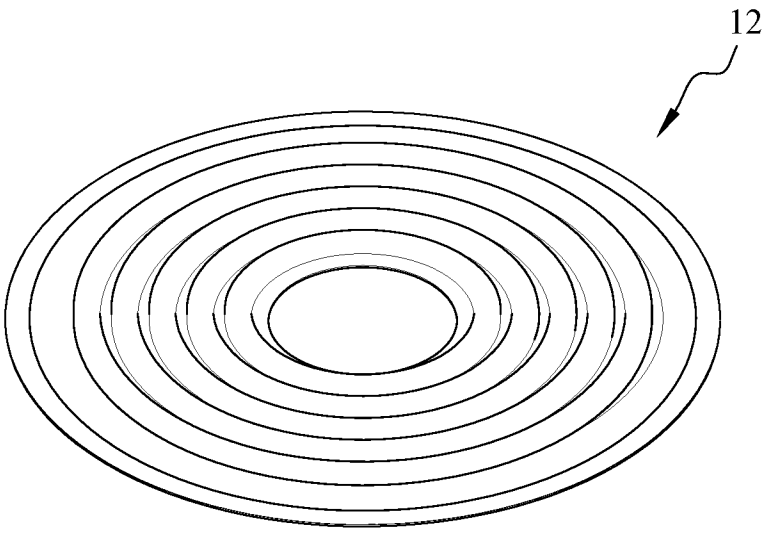
FIG. 2 (PRIOR ART)
FIG. 2 is a perspective view illustrating a conventional speaker damper.
Figure 3:
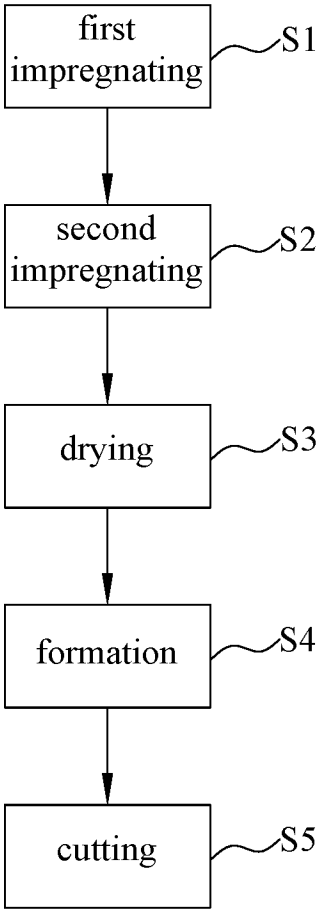
FIG. 3 is a flow chart showing the steps of a method for making a speaker vibrating member in accordance with the present invention.

FIG. 3 is a flow chart showing the steps of a method for making a speaker vibrating member in accordance with the present invention. As shown in FIG. 3, the method for making a speaker vibrating member according to the present invention includes the following steps:

First impregnating step S1: impregnating a fiber cloth with a resin solution for at least one time. In the present embodiment, the fiber cloth is impregnated with the resin solution for one time only. In other embodiments of the present invention, the fiber cloth may be impregnated with the resin solution for multiple times.

Second impregnating step S2: removing the fiber cloth from the resin solution, and impregnating the fiber cloth with a water-based rubber solution for at least one time. Preferably, the fiber cloth is impregnated with the water-based rubber solution for multiple times. In particular, the fiber cloth is dried directly after being removed from the resin solution, so a resin layer is formed on a surface of the fiber cloth. The dried fiber cloth is then impregnated with the water-based rubber solution. Subsequently, the fiber cloth is dried directly after being removed from the water-based rubber solution, so a rubber layer is formed on a surface of the resin layer of the fiber cloth. The dried fiber cloth is then impregnated with the water-based rubber solution again. The above steps are repeatedly performed so the fiber cloth is impregnated with the water-based rubber solution for multiple times until multiple rubber layers are formed on the resin layer of the fiber cloth. After the fiber cloth is impregnated with the water-based rubber solution for a last time, the fiber cloth is removed from the water-based rubber solution and is dried directly. The dried fiber cloth is impregnated with a release agent, so a release layer is formed on a surface of an uppermost rubber layer of the fiber cloth. Preferably, the rubber used in the water-based rubber solution is styrene-butadiene rubber (SBR), and the SBR has a concentration of 1%-80%. On the other hand, the release agent has a concentration of 5%10%. The SBR is a polymer of the styrene and butadiene. Specifically, there are two types of SBR, which are the emulsion styrene-butadiene rubber (ESBR) and the solution styrene-butadiene rubber (SSBR). The SBR is advantageous in that the physical characteristics, processing characteristics thereof and the properties of its manufactured goods are close to natural rubber. Some characteristics of the SBR are even more exceptional than those of the natural rubber, such as wear resistance, heat resistance, anti-aging characteristics and vulcanization speed.

Drying step S3: drying the fiber cloth. To be more specific, the fiber cloth is placed on a drying device for drying.

Formation step S4: forming at least one speaker vibrating member shaped portion on the dried fiber cloth with a hot embossing mold.

Cutting step S5: cutting the at least one speaker vibrating member shaped portion off from the dried fiber cloth to acquire at least one speaker vibrating member.

Since the drying step S3, the formation step S4 and the cutting step S5 are conventional steps, the details thereof will be omitted herein. The speaker vibrating member may be a damper, a drum paper or a connecting member.

Figure 4A:
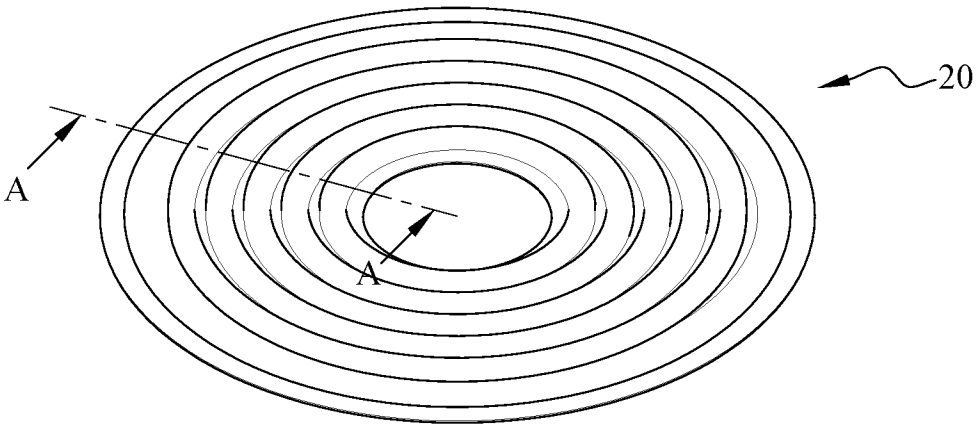
FIG. 4A is a perspective view illustrating the speaker vibrating member in accordance with the present invention.
Figure 4B:
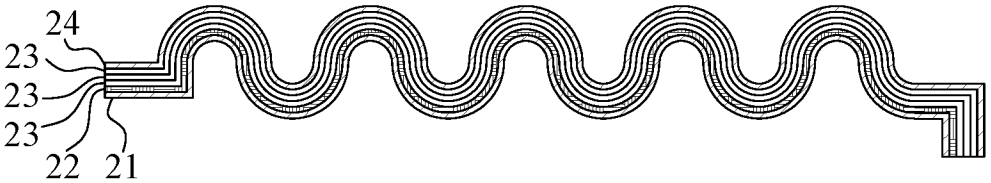
FIG. 4B is a sectional view of FIG. 4A taken along a line A-A, which illustrates the speaker vibrating member in accordance with the present invention.

FIG. 4A is a perspective view illustrating the speaker vibrating member in accordance with the present invention, and FIG. 4B is a sectional view of FIG. 4A taken along a line A-A, which illustrates the speaker vibrating member in accordance with the present invention. In FIG. 4A and FIG. 4B, the speaker vibrating member 20 is shown as a damper as an example; however, the speaker vibrating member 20 may also be a drum paper or a connecting member in other embodiments of the present invention. The speaker vibrating member 20, which is manufactured from the method provided by the present invention, includes a main body 21, a resin layer 22, at least one rubber layer 23 and a release layer 24. The resin layer 22 is disposed on a surface of the main body 21. The rubber layer 23 is disposed on a surface of the resin layer 22. As shown in FIG. 4B, The resin layer 22 covers the entire main body 21. The release layer 24 is disposed on a surface of the rubber layer 23. In the present embodiment, the speaker vibrating member 20 includes multiple rubber layers 23. One of the rubber layers 23 is disposed on the surface of the resin layer 22 to cover the entire resin layer 22, and the rest of the rubber layers 23 are laminated on one another layer by layer on top of the lowest rubber layer 23. The release layer 24 is disposed on a surface of an outermost rubber layer 23 and covers the outermost rubber layer 23. Preferably, the rubber layer 23 is a SBR rubber layer. Table 1 below shows the fatigue resistance test data of the speaker vibrating member of the present invention and a conventional speaker vibrating member.

TABLE 1

| | Subject | Test Subject | before vibration | 1 | 2 | 3 | 4 | 5 |
|---|---|---|---|---|---|---|---|---|
| Fatigue Resistance Test | speaker vibrating member of the present invention | post-vibration | 0.84 | 0.92 | 0.95 | 0.95 | 0.98 | 1.00 |
| | | rate of change % | 0% | 10% | 13% | 13% | 17% | 19% |
| | | post-vibration | 0.84 | 0.97 | 1.01 | 1.02 | 1.01 | 1.09 |
| | | rate of change % | 0% | 15% | 20% | 21% | 20% | 30% |
| | | post-vibration | 0.84 | 0.97 | 1.00 | 1.03 | 1.03 | 1.08 |
| | | rate of change % | 0% | 15% | 19% | 23% | 23% | 29% |
| | | mean value | 0% | 13% | 17% | 19% | 20% | 26% |
| | conventional speaker vibrating member | post-vibration | 0.84 | 0.98 | 1.00 | 1.04 | 1.09 | 1.06 |
| | | rate of change % | 0% | 17% | 19% | 24% | 30% | 26% |
| | | post-vibration | 0.84 | 1.02 | 1.06 | 1.06 | 1.10 | 1.08 |
| | | rate of change % | 0% | 21% | 26% | 26% | 31% | 29% |
| | | post-vibration | 0.84 | 0.98 | 1.04 | 1.04 | 1.06 | 1.05 |
| | | rate of change % | 0% | 17% | 24% | 24% | 26% | 25% |
| | | mean value | 0% | 18% | 23% | 25% | 29% | 27% |

| | Subject | Test Subject | before vibration | 6 | 7 | 8 | 9 | 10 |
|---|---|---|---|---|---|---|---|---|
| Fatigue Resistance Test | speaker vibrating member of the present invention | post-vibration | 0.84 | 0.98 | 1.01 | 1.02 | 1.02 | 1.07 |
| | | rate of change % | 0% | 17% | 20% | 21% | 21% | 27% |
| | | post-vibration | 0.84 | 1.03 | 1.08 | 1.09 | 1.09 | 1.09 |
| | | rate of change % | 0% | 23% | 29% | 30% | 30% | 30% |
| | | post-vibration | 0.84 | 1.07 | 1.08 | 1.04 | 1.09 | 1.08 |
| | | rate of change % | 0% | 27% | 29% | 24% | 30% | 29% |
| | | mean value | 0% | 22% | 26% | 25% | 27% | 29% |
| | conventional speaker vibrating member | post-vibration | 0.84 | 1.11 | 1.14 | 1.12 | 1.15 | 1.16 |
| | | rate of change % | 0% | 32% | 36% | 33% | 37% | 38% |
| | | post-vibration | 0.84 | 1.12 | 1.16 | 1.14 | 1.13 | 1.17 |
| | | rate of change % | 0% | 33% | 38% | 36% | 35% | 39% |
| | | post-vibration | 0.84 | 1.12 | 1.08 | 1.13 | 1.14 | 1.16 |
| | | rate of change % | 0% | 33% | 29% | 35% | 36% | 38% |
| | | mean value | 0% | 33% | 34% | 35% | 36% | 38% |

Figure 5:
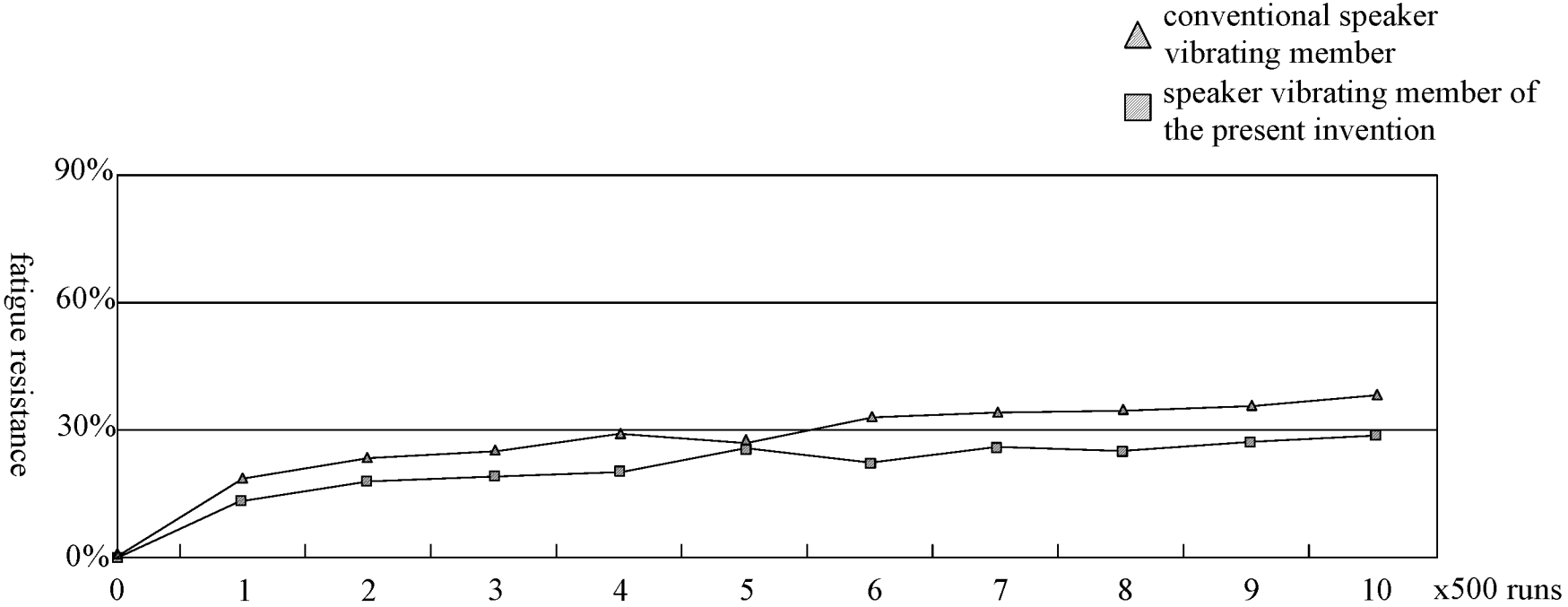
FIG. 5 is a graph illustrating the average rate of change of the fatigue resistance of a conventional speaker vibrating member and the speaker vibrating member of the present invention, according to the results of a fatigue resistance test.

Fatigue resistance test-runs * distance traveled (mm): 500 * 10(2.5 + 2.5) mm; Weight: 200 g In Table 1, "1-10" represents the number of vibrations, which are 500 times, 1000 times, 1500 times, 2000 times, 2500 times, 3000 times, 3500 times, 4000 times, 4500 times and 5000 times, respectively. The "rate of change" herein indicates "the rate of change in the shape of the damper"; the "mean value" herein indicates "the mean value of the rate of change of three speaker vibrating members of the present invention from the fatigue resistance test" and "the mean value of the rate of change of three conventional speaker vibrating members from the fatigue resistance test". A high rate of change indicates a higher degree of change in the shape of the damper and a poor fatigue resistance; on the contrary, a low rate of change indicates a low degree of change in the shape of the damper and a good fatigue resistance. The mean values of the rate of change of the "speaker vibrating member of the present invention" and "conventional speaker vibrating member" shown in Table 1 are plotted as the graph shown in FIG. 5. It can be learned from Table 1 and FIG. 5 that "the mean value of the rate of change of the speaker vibrating member of the present invention" is lower than "the mean value of the rate of change of conventional vibrating member". Thus, it is proved that "the fatigue resistance of the speaker vibrating members manufactured from the method provided by the present invention" is superior to "the fatigue resistance of the speaker vibrating members manufactured from conventional methods".

In the method of making a speaker vibrating member provided by the present invention, the fiber cloth is impregnated with the resin solution in the first impregnating step S1 to form the resin layer on the surface of the fiber cloth. However, once the resin layer is formed on the surface of the fiber cloth, the stiffness of the overall fiber cloth may become overly high, and the fiber cloth may lack flexibility. Hence, the fiber cloth is impregnated with the water-based rubber solution in the second impregnating step S2 of the present invention to form the rubber layer on the resin layer. In such a way, the rubber layer may lower the overall stiffness of the fiber cloth, which had a higher stiffness due to the resin layer, thereby achieving the goal of softening the fiber cloth with resin layer. Further, the speaker vibrating member 20 manufactured may be more flexible and may have a better fatigue resistance; consequently, the sound quality of the speaker may be enhanced. In particular, the abovementioned effects are even more exceptional when the rubber used to form the rubber layer is SBR.

In addition, in the method of making a speaker vibrating member provided by the present invention, the fiber cloth is impregnated with the resin solution for one time in the first impregnating step S1 to form a resin layer on the surface of the fiber cloth. Subsequently, the fiber cloth is impregnated with the water-based rubber solution for multiple times to form multiple rubber layers on the resin layer. As such, the more the rubber layers are formed on the resin layer, the lower the stiffness of the fiber cloth with the resin layer becomes. In order to acquire a fiber cloth with a desired stiffness, users may control the number of times of which the fiber cloth is impregnated with the water-based rubber solution to adjust the number of the rubber layers. As a result, the speaker vibrating member manufactured may have a higher flexibility and a more notable fatigue resistance, so the sound quality of the speaker may be enhanced. In particular, the abovementioned effects are even more exceptional when the rubber used for forming the rubber layer is SBR.

More importantly, since the SBR with a concentration of 1%-80% already has an outstanding softening effect on the fiber cloth with resin layer as compared to the SBR with a concentration of 100%, SBR may be mixed with water as the water-based SBR solution for the purpose of cost saving.

Additionally, in the method of making a speaker vibrating member of the present invention, after the fiber cloth is impregnated with the water-based rubber solution for a last time in the second impregnating step S2, the fiber cloth is removed from the water-based rubber solution and is impregnated with a release agent, so the release layer is formed on the surface of the outermost rubber layer of the fiber cloth. Consequently, the fiber cloth may be prevented from sticking with the mold during the formation step S4 due to the protection provided by the release layer at the outermost part of the fiber cloth, so the fiber cloth may be removed smoothly from the mold.

It is worth mentioning that a release agent with a concentration of 5% to 10% is more than capable of achieving the advantageous effects mentioned above in an outstanding and exceptional manner.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A method for making a speaker vibrating member, comprising the steps of:

a first impregnating step: impregnating a fiber cloth entirely with a resin solution for at least one time;

a second impregnating step: removing the fiber cloth from the resin solution, and impregnating the entire fiber cloth with a water-based rubber solution for at least one time;

a drying step: drying the fiber cloth;

a formation step: forming at least one speaker vibrating member shaped portion on the dried fiber cloth; and a cutting step: cutting the at least one speaker vibrating member shaped portion off from the dried fiber cloth to acquire the speaker vibrating member;

wherein the first and second impregnating steps form a resin layer on the entire fiber cloth and at least a rubber layer covering the entire resin layer.

2. The method according to claim 1, wherein the fiber cloth is impregnated with the resin solution for one time in the first impregnating step, and the fiber cloth is removed from the resin solution to be impregnated in the water-based rubber solution for multiple times in the second impregnating step.

3. The method according to claim 2, wherein in the second impregnating step, the fiber cloth is dried directly after being removed from the resin solution, and the dried fiber cloth is impregnated with the water-based rubber solution; subsequently, the fiber cloth is dried directly after being removed from the water-based rubber solution, and the dried fiber cloth is impregnated with the water-based rubber solution again; wherein the above steps are repeatedly performed until the fiber cloth is impregnated with the water-based rubber solution for multiple times.

4. The method according to claim 1, wherein after the fiber cloth is impregnated with the water-based rubber solution for a last time in the second impregnating step, the fiber cloth is removed from the water-based rubber solution and is impregnated with a release agent.

5. The method according to claim 4, wherein the fiber cloth is dried directly after being removed from the water-based rubber solution, and the dried fiber cloth is impregnated with the release agent, which has a concentration of 5%-10%.

6. The method according to claim 1, wherein a type of rubber used in the water-based rubber solution is styrene-butadiene rubber (SBR), and the SBR has a concentration of 1%-80%.

* * * * *